United States Patent [19]

Knorreck

[11] Patent Number: 4,854,282

[45] Date of Patent: Aug. 8, 1989

[54] DEVICE FOR SECURING CONTROL MAGNETS ON INJECTION PUMPS FOR DIESEL FUEL

[75] Inventor: Peter Knorreck, Weissach, Fed. Rep. of Germany

[73] Assignee: Robert Bosch GmbH, Stuttgart, Fed. Rep. of Germany

[21] Appl. No.: 106,218

[22] Filed: Oct. 9, 1987

[30] Foreign Application Priority Data

Oct. 29, 1986 [DE] Fed. Rep. of Germany ..... 3636747

[51] Int. Cl.[4] ..... F02M 39/00

[52] U.S. Cl. ..... 123/357; 123/364; 335/277

[58] Field of Search ..... 123/357, 358, 359, 364; 335/277

[56] References Cited

U.S. PATENT DOCUMENTS

| | | | |
|---|---|---|---|
| 2,180,539 | 11/1939 | Miller | 335/277 |
| 2,223,758 | 12/1940 | Dillström | 103/41 |
| 2,727,191 | 12/1955 | Kinsley | 335/277 |
| 3,202,161 | 8/1965 | Richards | 123/359 |
| 3,485,228 | 12/1969 | Updyke | 123/358 |
| 3,750,633 | 8/1973 | Ohtani et al. | 123/102 |
| 3,787,810 | 1/1974 | Bonny | 335/277 |
| 3,902,144 | 8/1975 | Fischer | 335/277 |
| 3,970,977 | 7/1976 | Weissberger | 335/277 |
| 4,242,606 | 12/1980 | Nonnenmann | 310/12 |
| 4,495,914 | 1/1985 | Ishii | 123/357 |
| 4,523,562 | 6/1985 | Schapper | 123/357 |
| 4,576,130 | 3/1986 | Hafele | 123/357 |

OTHER PUBLICATIONS

SAE850170, "High-Pressure Injection Pumps with Electronic Control for Heavy-Duty Diesel Engines", p. 10, FIG. 16-Electromagnetic Actuator for In-Line Pumps.

*Primary Examiner*—Carl S. Miller

*Attorney, Agent, or Firm*—Edwin E. Greigg

[57] ABSTRACT

The control magnet is secured with cap screws on a cap of a control mechanism of an injection pump by means of a holder element, which is a two-armed leaf spring having pre-stressing. The leaf spring has a middle section which comes to rest flush on the magnet core and both arms come to rest flush on a support face of the cap. The spring force spring stressing of the two-armed leaf spring pre-stressed in this manner has an effect of keeping the control magnet secured such that it is not jarred loose even in the event of high acceleration peaks of the injection pump.

3 Claims, 1 Drawing Sheet

DEVICE FOR SECURING CONTROL MAGNETS ON INJECTION PUMPS FOR DIESEL FUEL

BACKGROUND OF THE INVENTION

The invention relates to a device for securing control magnets on injection pumps for Diesel fuel. A securing device of this kind has a rigid claw as its holder element, which is secured on the injection pump and presses the control magnet housing against the shoulder of a housing part of the injection pump. In practice, however, it has been found that this holder element does not reliably prevent loosening of the control magnet, which loosening originates in the acceleration peaks of the Diesel drive and which decrease the functions of the cooperating portions of the control magnet and of the injection pump. Such loosening of the control magnet impairs its electrical connection, destroys the fastening and installing parts, because of the masses involved, and thus imperils the functional reliability of the injection pump.

OBJECT AND SUMMARY OF THE INVENTION

With the device according to the invention for securing control magnets on injection pumps for Diesel fuel, the above-mentioned problem in the prior art is solved with technologically simple means that function dependably. The invention is based on the concept of using a spring-elastic holder element embodied as a leaf spring for securing the control magnet on the injection pump and to predetermine the magnitude of the spring force (spring stressing) resulting from securing the spring on the injection pump in such a way that loosening of the control magnet is reliably avoided even in the event of high acceleration peaks.

Advantageous further embodiments of the invention are described hereinafter. With one embodiment a favorable selection is made from among the many possible types of springs subjected to bending an advantageous disposition of the leaf spring is disclosed herein. In one embodiment the securing force is increased on the one hand, and on the other, the magnet core is fixed directly in the control magnet. Further a disposition of the cap screws enable uniform securing of the control magnet on the injection pump.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
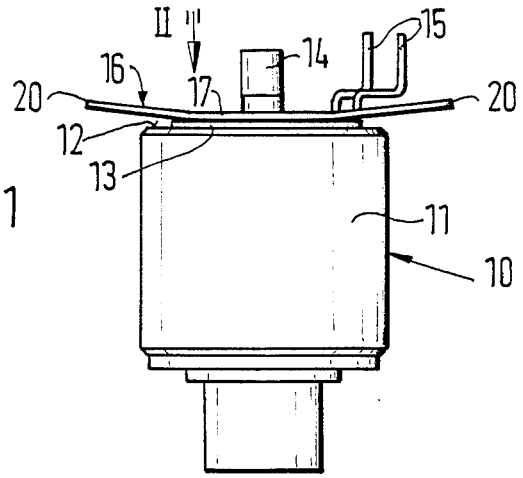
FIG. 1 is a side view of a control magnet having a pre-stressed holder element.
Figure 2:
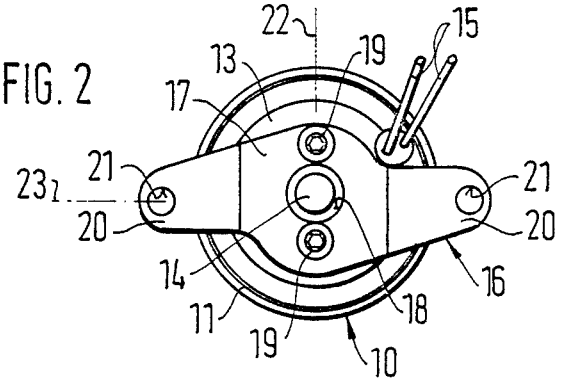
FIG. 2 is a plan view on the control magnet in the direction indicated by the arrow II in FIG. 1.

A control magnet 10 in FIGS. 1 and 2 has a substantially cylindrical, stepped housing 11, from one face end 12 of which a magnet core 13 protrudes and includes a rod-like reciprocating device 14. The two electrical connection wires of the control magnet 10 are shown at 15.

A holder element 16 is embodied as a spring subjected to bending, taking the form of a two-armed leaf spring 16; its middle section 17 has a central opening 18, through which the reciprocating device 14 protrudes. By means of two cap screws 19, the middle section 17 of the leaf spring 16 is secured on the magnet core 13. Both cap screws 19 are disposed in a plane 22 transverse to the longitudinal extension 23 of the leaf spring 16, and the central opening 18 is located between the two cap screws 19. Each of the two arms 20 of the two-armed leaf spring 16 has a bore 21 and is bent slightly with respect to the middle section 17. The leaf spring 16 is secured to the control magnet 10 in such a way that both arms 20 point away from the magnet core 13 and hence away from the control magnet 10.

Figure 3:
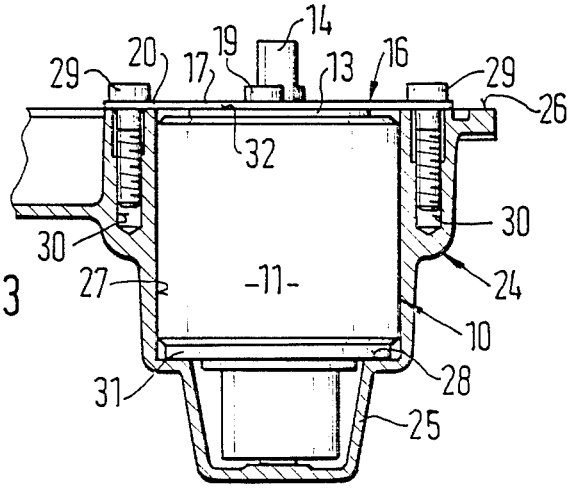
FIG. 3 is a fragmentary sectional view taken through a cap of a control mechanism of an injection pump and the control magnet secured by means of the holder element.

FIG. 3 shows a cap 24 of a control mechanism, not shown, for a Diesel fuel injection pump, the cap having a hood 25 that extends to the support face 26 and has a cylindrical inner wall 27 and a circular-annular shoulder 28. The pre-assembled unit comprising the control magnet 10 and leaf spring 16 is inserted into the hood 25 until an annular plate 31 of the housing 11 is supported on the shoulder 28 of the hood 25. In this process, the face end 32 of the magnet core 13 and the support face 26 of the cap 24 adjoining it are substantially located in the same plane. Each arm 20, which in the nonsecured state of the leaf spring 16 points away from the cap 24 or support face 26 of the injection pump, is secured on the support face 26 by a cap screw 29 threaded into an internal thread 30 of the cap 24. In this state, flush contact of the middle section 17 with the face end 32 of the magnet core 13 and also of each of the two arms 20 with the support face 26 of the cap 24 is attained. By means of this securing device and above all because of the pre-stressing of the leaf spring 16, the control magnet 10 is disposed in the injection pump in such a way that it cannot be jarred loose.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A device for securing a control magnet onto an injection pump for Diesel fuel, which comprises:

a stepped, cylindrical housing (11) have a face end (12);

a control magnet (10) including a magnetic core (13) supported in said stepped, cylindrical housing with one end protruding beyond said face end of said stepped, cylindrical housing;

a rod-like reciprocating device (14) extending upwardly and protruding from said control magnet and controlled thereby;

a holder element embodied as a leaf spring adjacent said protruding end of said magnetic core;

said leaf spring having a middle section with outwardly extending arms (20) having outer ends and a central opening (18) through which said rod-like reciprocating device reciprocates;

said outwardly extending arms of said leaf spring are prestressed and disposed in such a way that said outer ends of said arms (20), in a nonsecured state of said arms, are directed away from said face end of said stepped, cylindrical housing;

said middle section (17) of said leaf spring (16) including said central opening (18) is secured to said protruding end of said magnet core (13) with said rod-like reciprocating device extending through said central opening (18);

each arm (20) of said leaf spring (16) adapted to be secured to a cap (24) of a control mechanism of an injection pump by means of screws (29); and said lead spring (16), in its functional state, rests flush on both the magnet core (13) and the cap (24) to which it is to be secured.

2. A device as defined by claim 1, in which said middle section (17) of the leaf spring (16) is secured on the magnet core (13) by means of two screws (19);

both screws (19) are disposed in a plane (22) transverse to a longitudinal extension (23) of the leaf spring (16); and the opening (18) is located between the two screws (19).

3. A device as defined by claim 2, in which, said injection pump includes a control mechanism including a cap;

said cap includes a cylindrical portion and a hood 25 forming a shoulder 28 with said cylindrical portion;

said stepped housing of said control magnet is positioned within said cap with one end supported on said shoulder (28); and said arms of said leaf spring are secured to said cap to secure said control magnet within said cap to prevent loosening of said control magnet.

* * * * *